US008316655B2

(12) United States Patent
Adler

(10) Patent No.: US 8,316,655 B2
(45) Date of Patent: Nov. 27, 2012

(54) METHOD FOR CONVERTING THERMAL ENERGY AT A LOW TEMPERATURE INTO THERMAL ENERGY AT A RELATIVELY HIGH TEMPERATURE BY MEANS OF MECHANICAL ENERGY, AND VICE VERSA

(76) Inventor: Bernhard Adler, Gerasdorf (AT)

( * ) Notice: Subject to any disclaimer, the term of this patent is extended or adjusted under 35 U.S.C. 154(b) by 395 days.

(21) Appl. No.: 12/671,314

(22) PCT Filed: Jul. 21, 2008

(86) PCT No.: PCT/AT2008/000265

§ 371 (c)(1),
(2), (4) Date: Apr. 27, 2010

(87) PCT Pub. No.: WO2009/015402

PCT Pub. Date: Feb. 5, 2009

(65) Prior Publication Data

US 2010/0199691 A1 Aug. 12, 2010

(30) Foreign Application Priority Data

Jul. 31, 2007 (AT) ..... 1203/2007

(51) Int. Cl.
*F25B 9/00* (2006.01)

(52) U.S. Cl. ..... 62/86; 62/402

(58) Field of Classification Search ..... 62/86, 56, 62/402, 404, 499, 160; 165/88, 90; 417/220, 417/247; 415/64, 121.1
See application file for complete search history.

(56) References Cited

U.S. PATENT DOCUMENTS 2,393,338 A 1/1946 Roebuck
(Continued)

FOREIGN PATENT DOCUMENTS

DE 22 27 189 A1 12/1972
(Continued)

OTHER PUBLICATIONS

International Preliminary Report on Patentability, PCT/IPEA/409, issued in corresponding PCT Application No. PCT/AT2008/000265, in English and German, along with the PCT/IPEA/416 in German indicating a mailing date of Nov. 23, 2009, 11 pages total.

(Continued)

*Primary Examiner* — Mohammad Ali
(74) *Attorney, Agent, or Firm* — Sughrue Mion, PLLC

(57) ABSTRACT

Method for converting thermal energy at a low temperature into thermal energy at a relatively high temperature by means of mechanical energy, and vice versa, with a working medium which runs through a closed thermodynamic circulation process, wherein the circulation process has the following working steps: —reversible adiabatic compression of the working medium, —isobaric conduction away of heat from the working medium, —reversible adiabatic relaxing of the working medium, —isobaric supply of heat to the working medium, and wherein the increase or decrease in pressure of the working medium is produced during the compression or relaxing, increasing or decreasing the centrifugal force acting on the working medium, with the result that the flow energy of the working medium is essentially retained during the compression or relaxing process.

25 Claims, 11 Drawing Sheets

U.S. PATENT DOCUMENTS

Figure 1:
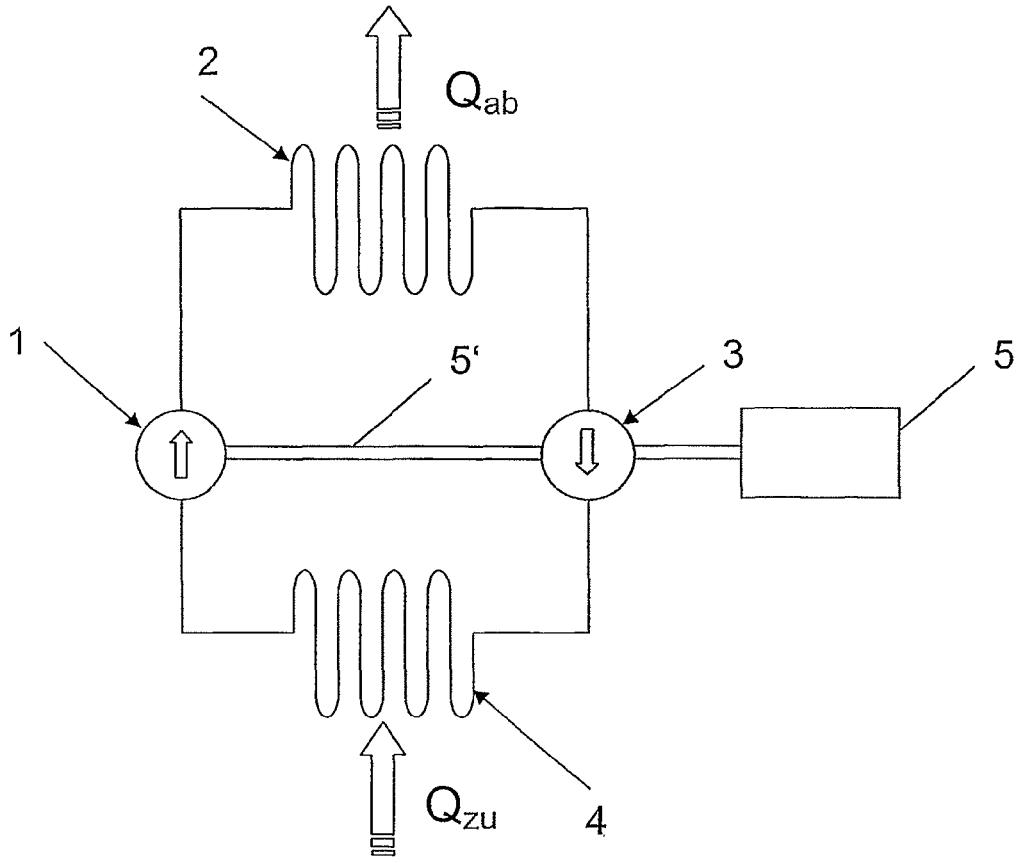

| | | | | | |
|---|---|---|---|---|---|
| 2,490,064 | A | * | 12/1949 | Kollsman | 60/682 |
| 2,490,065 | A | * | 12/1949 | Kollsman | 62/402 |
| 3,926,010 | A | * | 12/1975 | Eskeli | 62/401 |
| 4,117,695 | A | * | 10/1978 | Hargreaves | 62/86 |
| 4,433,551 | A | * | 2/1984 | Dibrell | 62/87 |
| 4,524,587 | A | * | 6/1985 | Kantor | 62/101 |
| 4,984,432 | A | * | 1/1991 | Corey | 62/87 |
| 5,274,997 | A | * | 1/1994 | Inoue et al. | 60/39.511 |
| 5,355,691 | A | * | 10/1994 | Sullivan et al. | 62/201 |
| 5,765,387 | A | * | 6/1998 | Amin | 62/401 |
| 6,196,020 | B1 | * | 3/2001 | Nowacki et al. | 62/499 |
| 6,679,076 | B1 | * | 1/2004 | Duga et al. | 62/228.1 |
| 8,051,655 | B2 | * | 11/2011 | Silver et al. | 60/516 |
| 2003/0190230 | A1 | * | 10/2003 | Ito | 415/143 |
| 2007/0144192 | A1 | * | 6/2007 | Kidwell | 62/209 |
| 2007/0154304 | A1 | * | 7/2007 | Abdallah | 415/199.1 |

FOREIGN PATENT DOCUMENTS

| | | | |
|---|---|---|---|
| DE | 27 29 134 | A1 | 1/1978 |
| DE | 30 18 756 | A1 | 1/1982 |
| FR | 2 749 070 | A | 11/1997 |
| GB | 1 217 882 | A | 12/1970 |
| WO | 98/030846 | A1 | 7/1998 |

OTHER PUBLICATIONS

Sangkwon Jeong, et al., "Modified Roebuck compression device for cryogenic refrigeration system of superconducting rotating machine", Cryogenics, Aug. 2002, pp. 501 to 507, vol. 42, No. 8.

International Search Report of PCT/AT2008/000265 dated Jan. 13, 2009 and Austrian Office Action of A 1203/2007 dated Mar. 5, 2008.

* cited by examiner

METHOD FOR CONVERTING THERMAL ENERGY AT A LOW TEMPERATURE INTO THERMAL ENERGY AT A RELATIVELY HIGH TEMPERATURE BY MEANS OF MECHANICAL ENERGY, AND VICE VERSA

CROSS REFERENCE TO RELATED APPLICATION

This application is a National Stage of International Application No. PCT/AT2008/000265 filed Jul. 21, 2008, claiming priority based on Austrian Patent Application No. AT A1203/2007, filed Jul. 31, 2007, the contents of all of which are incorporated herein by reference in their entirety.

The invention relates to a method for converting thermal energy at a low temperature into thermal temperature at a relatively high temperature by means of mechanical energy and vice versa, i.e., converting thermal energy of a relatively high temperature into thermal energy of a relatively low temperature during the release of mechanical energy, with a working medium that runs through a closed thermodynamic circulation process, wherein the circulation process exhibits the following working steps:

Reversible adiabatic compression of the working medium,

Isobaric conduction of heat away from the working medium,

Reversible adiabatic relaxing of the working medium,

Isobaric supply of heat to the working medium.

In addition, the invention relates to a device for implementing a method according to the invention with a compressor, a relaxing unit and a respective heat exchanger for the supply or removal of heat.

Known from prior art are various devices, so-called heat pumps, in which a motor is normally used to heat a working medium at a low temperature to a relatively high temperature by increasing the pressure. In known heat pumps, the working medium runs through a thermodynamic circulation process, wherein this thermodynamic circulation process encompasses evaporation, compression, liquefaction, and expanding the working medium at an inductor; i.e., the aggregate condition of the working medium normally changes.

In known heat pumps, use is normally made of the coolant R134a or a mixture comprised of R134a among other ingredients, which does not have a deleterious effect on the ozone, but still has a 1300 times greater of a greenhouse-generating effect than the same quantity of $CO_2$. Such methods are essentially implemented according to the Carnot process, and exhibit a theoretical performance number or COP (coefficient of performance), i.e., a correlation between the released heat to the used electrical energy of approx. 5.5 (when "pumping" the working medium from 0 to 35° C.). However, the best performance coefficient achieved to date only came to 4.9; as a rule, good heat pumps currently produce a performance coefficient of approx. 4.7.

Known from WO 1998/30846 A1 is a device that can be used as a refrigerator or a motor, wherein air is here used as the working medium, aspirated from the environment and again released to the environment after being compressed or relaxed. In such an open system, it is disadvantageous that an angular momentum builds up as the working medium enters into the machine, and is relieved as the working medium exits the machine, thereby yielding significant friction losses.

Known from DE 27 29 134 A1 is a device with a hollow rotor, wherein guide passages or guide vanes are here provided on the outer periphery of the rotating body, so that a high relative velocity arises between the guide passages and working medium. Such guide vanes also produce very high losses in flow energy, which leads to a relatively low performance coefficient.

Known from FR 2 749 070 A1 is merely another type of heat pump with a conventional turbocompressor or a toothed displacer.

Further known from GB 1 217 882 A is a thermodynamic device that essentially does make use of centrifugal force, but is here also provided with an induction point, thereby giving rise to considerable friction losses.

On the other hand, numerous methods are also known from prior art, which involve in particular converting the heat from geothermal liquid and geothermal vapor into electrical energy. In the so-called KALINA process, heat is released from water to an ammonia-water mixture, thereby already producing vapor at significantly lower temperatures, which is used to power turbines. Such a KALINA process is described in U.S. Pat. No. 4,489,563, for example.

While the attainment of very high performance coefficients is theoretically possible in the most varied heat exchange methods, conventional compressors and relaxing units in which the working medium is compressed and relaxed in the gaseous range usually have a relatively poor efficiency.

As a consequence, the object of the present invention is to improve the efficiency or performance coefficient during the conversion of thermal energy of a low temperature into thermal energy of a relatively high temperature by means of mechanical energy and vice versa.

This is achieved according to the invention by increasing or decreasing the pressure of the working medium during compression or relaxation by increasing or educing the centrifugal force acting on the working medium, so that the flow energy of the working medium is essentially preserved during compression or relaxation. A clearly higher efficiency is achieved by the utilization of centrifugal acceleration and retention of flow energy in the working medium by comparison to conventional compressors, in which the high velocity of the working medium at the periphery of the compressor is converted into pressure, thereby yielding a poor efficiency. In like manner, the efficiency is increased during relaxation by reducing the pressure of the working medium in the course of relaxation by decreasing the centrifugal force. This significantly improves the performance coefficient or efficiency of the entire method.

In addition, it is advantageous for improving efficiency that the working medium be gaseous over the entire circulation process, since work can be recovered in a way that makes sense from the standpoint of energy as the gaseous working medium expands, while not being relevant in terms of energy with respect to liquid media. Further, the influence on efficiency in the gaseous range is greater than in the 2-phase range.

With regard to a high compression by means of centrifugal acceleration, it is advantageous to use gases with a lower specific thermal capacity at a constant pressure (cp) or with a higher density. As a consequence, the working medium used is preferably a noble gas, in particular krypton, xenon, argon or radon, or a mixture thereof. Further, it has been demonstrated to be beneficial for the pressure in the closed circulation process to measure at least in excess of 50 bar, in particular in excess of 70 bar, preferably essentially 100 bar, i.e., for the pressure to be comparatively high during the entire process. The comparatively high pressure makes it possible to keep the pressure loss in the heat exchanger low, since the transfer of heat is comparably high at comparatively low flow rates.

Carrying out the circulation process in close proximity to the critical point of the gaseous working medium further improves the overall efficiency or increases the performance coefficient, wherein the critical point is present as a function of the used working medium at a varying pressure or temperature. The overall performance coefficient or overall efficiency is maximized by having relaxation take place in an entropy range as close as possible to the entropy of the respective critical point. Further, it is advantageous for the lower relaxation temperature to lie just over the critical point. The critical point can be adjusted to the desired process temperature using gas mixtures.

A structurally simple and efficient cooling or heating of the working medium can be achieved by removing and supplying heat using a heat exchange medium with an isentropic exponent Kappa ~1, i.e., media in which the temperature remains essentially constant given a pressure increase, in particular a liquid heat exchange medium.

In the device for implementing the method according to the invention, the compressor or relaxation unit does not exhibit a guide vane, and are configured in such a way that the pressure of the working medium is increased or decreased by increasing or decreasing the centrifugal force acting on the working medium. As already described above in conjunction with the method according to the invention, this yields a distinct improvement in efficiency during compression and expansion of the working medium, thereby clearly improving the performance coefficient or efficiency of the device according to the invention by comparison to known devices.

In terms of a structurally simple configuration of the heat exchanger, it is advantageous for the heat exchangers to each exhibit at least one pipe that carries a liquid heat transfer medium.

With respect to achieving a low-friction transition from the compressor to the relaxation unit, i.e., to retain the flow energy of the working medium, it is advantageous that the relaxation unit connect directly to the compressor by way of the heat exchanger. In terms of a structurally simple configuration of the device, it is advantageous to mount the impellers of the compressor and relaxation unit on a shared torque shaft.

One structurally easy way to increase the pressure of the working medium via centrifugal acceleration is to provide a casing that rotates together with the impellers of the compressor and relaxation unit.

In order to achieve an efficient cooling of the compressed working medium, it is advantageous that the casing accommodate a co-rotating heat exchanger. The co-rotating heat exchanger is most advantageously arranged on the outside periphery.

However, instead of the casing co-rotating with the impellers, it is just as conceivable that the impellers be enveloped by a fixed casing. This enables a reduction in the structural outlay. In order to avoid friction losses of the working medium on a pipe of the heat exchanger connected with the fixed casing, however, it is advantageous for the pipe of the heat exchanger to be partially incorporated into the casing, wherein the surface of the fixed casing that comes into contact with the working medium has the smoothest possible design.

In order to avoid outer, rotating parts, it makes sense to provide a torsion-resistant casing that envelops the compressor and relaxation unit.

To achieve an efficient supply of heat to the working medium, it is advantageous for the two heat exchangers to be incorporated in the casing.

Providing at least one rotatably mounted pipeline system that circulates the working medium yields a device with a comparably low overall weight, since the wall thickness of the pipes carrying the working medium can be reduced by comparison to that of the casings accommodating the working medium.

With respect to compressing the working medium in the pipeline system via centrifugal force, it is advantageous for the pipeline system to exhibit linear compression pipes running in a radial direction.

In order to reliably circulate the working medium in the pipeline system, it is advantageous for the pipeline system to exhibit relaxation pipes bent against the rotational direction of the torque shaft. The relaxation pipes can here have a circularly bent cross section to simplify the structural design. As an alternative, the relaxation pipes can also exhibit a bend with a cross sectional radius that constantly diminishes toward the instant center. This makes it possible to reduce any turbulence that arises in the pipeline system.

In addition, a flow of the working medium in the pipeline system is reliably ensured by incorporating a bucket wheel in the pipeline system that rotates relative to the pipeline system. The bucket wheel is designed as a compressor, relaxation turbine or guide vane, and can here be arranged in a torsion-resistant manner, wherein the torsion-resistant arrangement gives rise to a relative movement to the rotating pipeline system. It is also conceivable that the bucket wheel, for example, be provided with a motor for generating or using a relative movement to the pipeline system, or a generator, which converts the generated shaft output into electrical energy via the relative movement of the bucket wheel.

With regard to a simple and efficient heat supply or removal, it is advantageous for axially running sections of the pipeline system to be enveloped by coaxially arranged pipes of the heat exchanger.

In order to supply the difference between the necessary energy from compression and recovered energy from relaxation to the device during operation as a heat pump, it is advantageous that a motor be connected with the torque shaft or pipeline system.

To convert the mechanical energy obtained from varying temperature levels into electrical energy, i.e., when using the device as a thermal engine, it is advantageous for a generator to be connected with the torque shaft.

Figure 2:
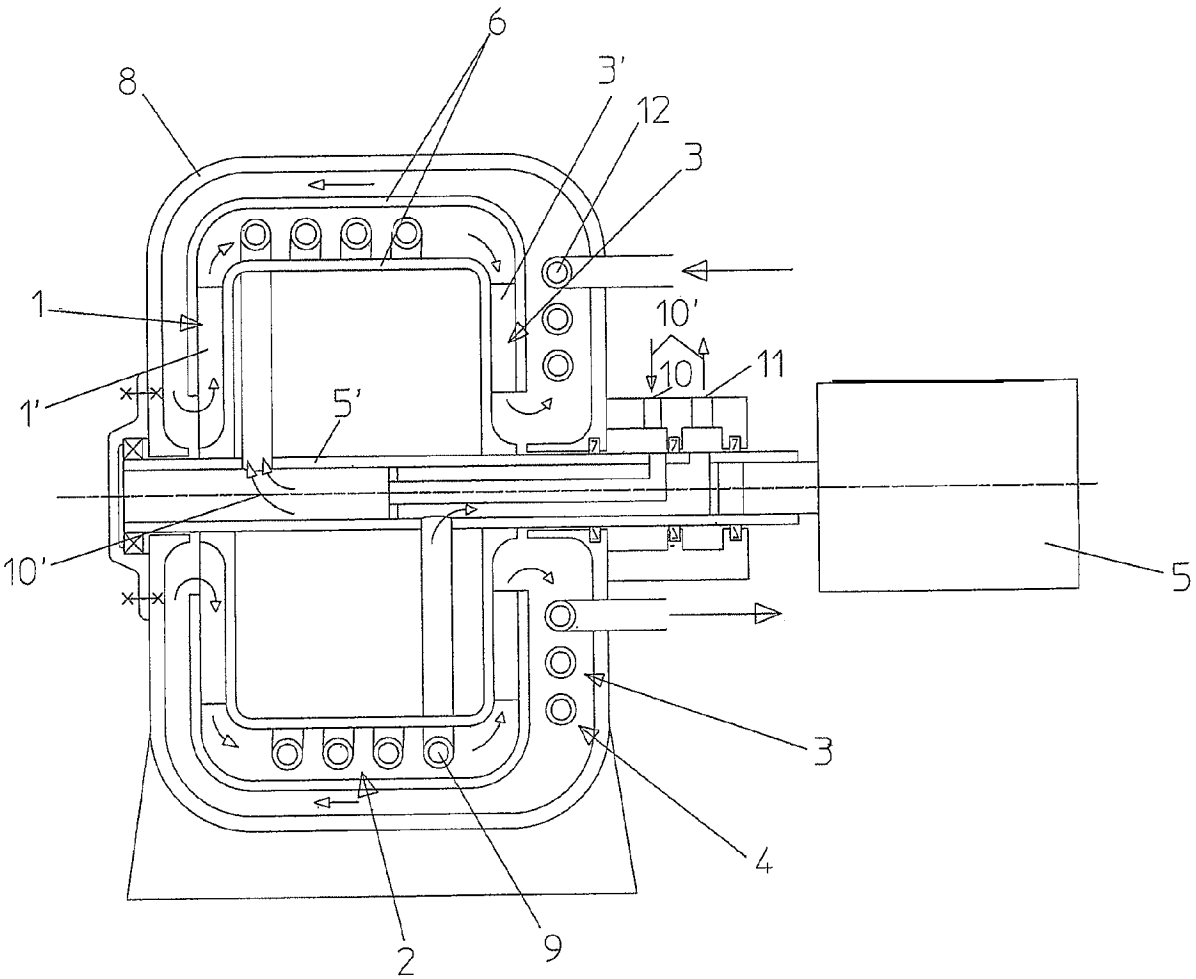
Figure 3:
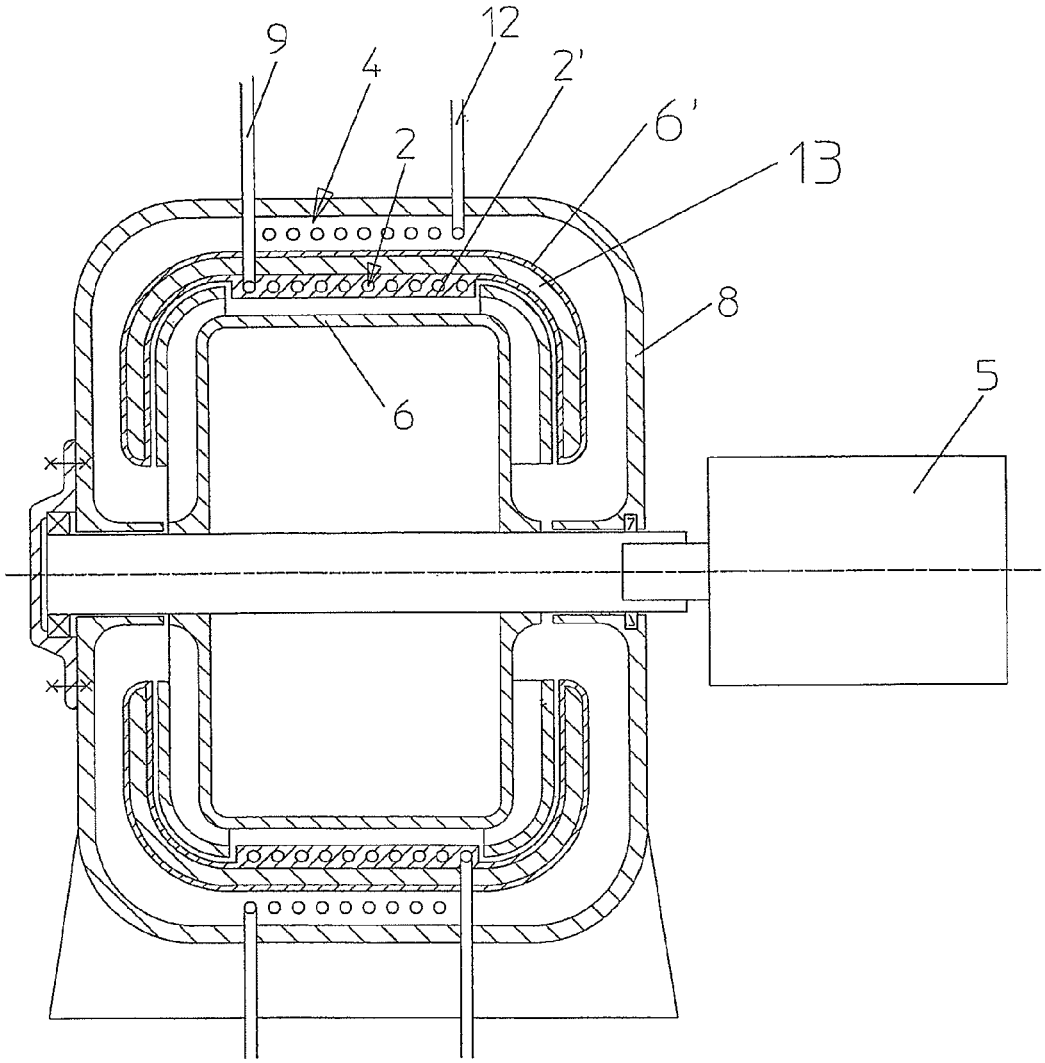
Figure 4:
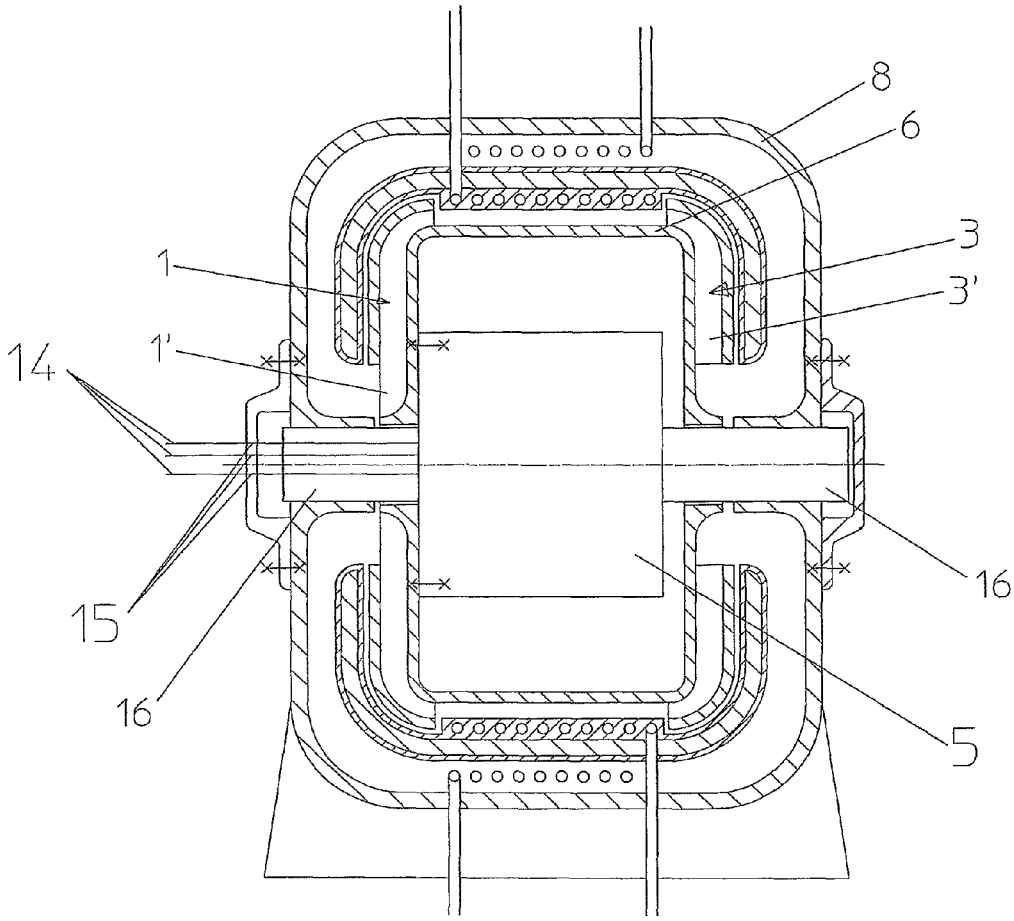
Figure 5:
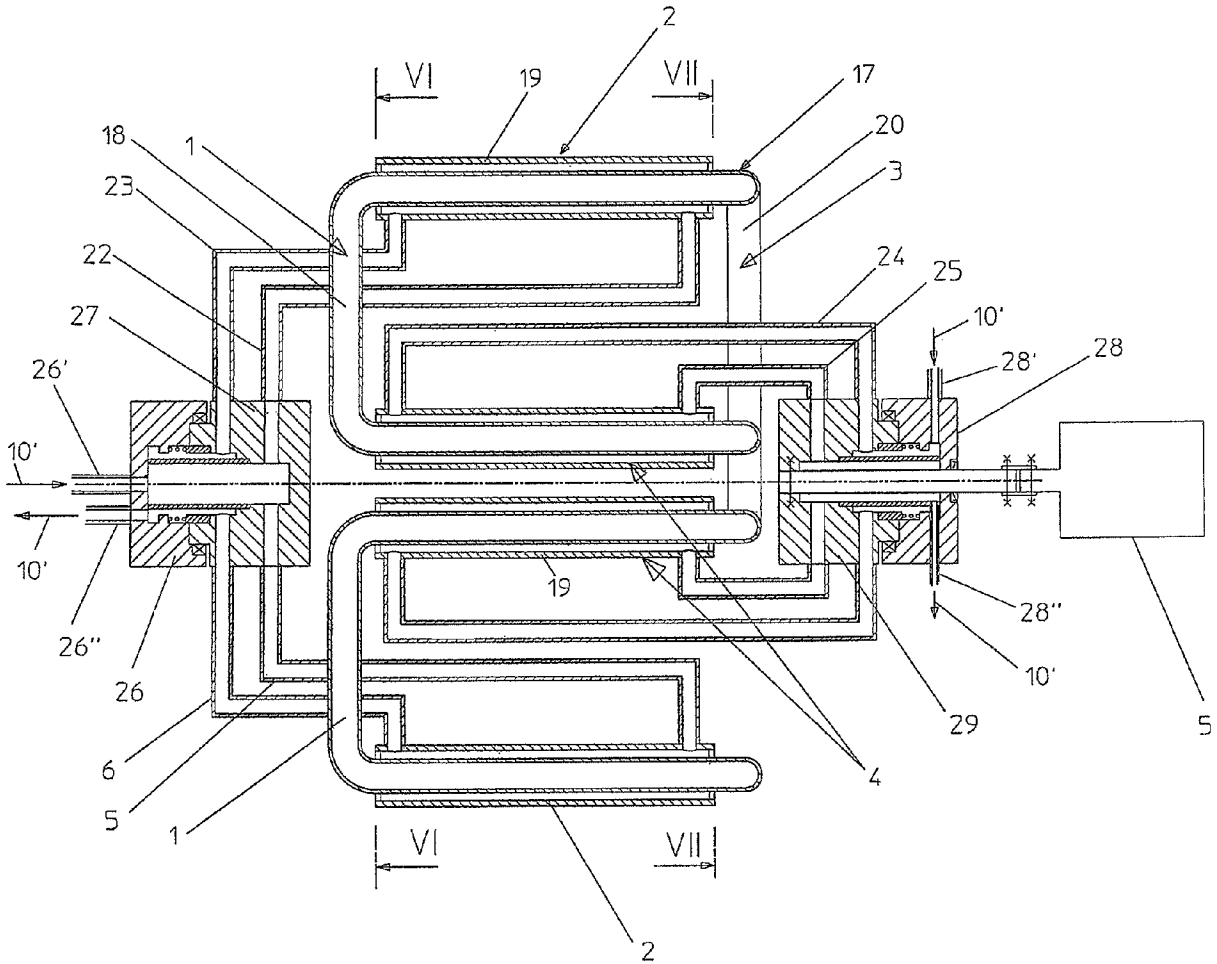
Figure 6:
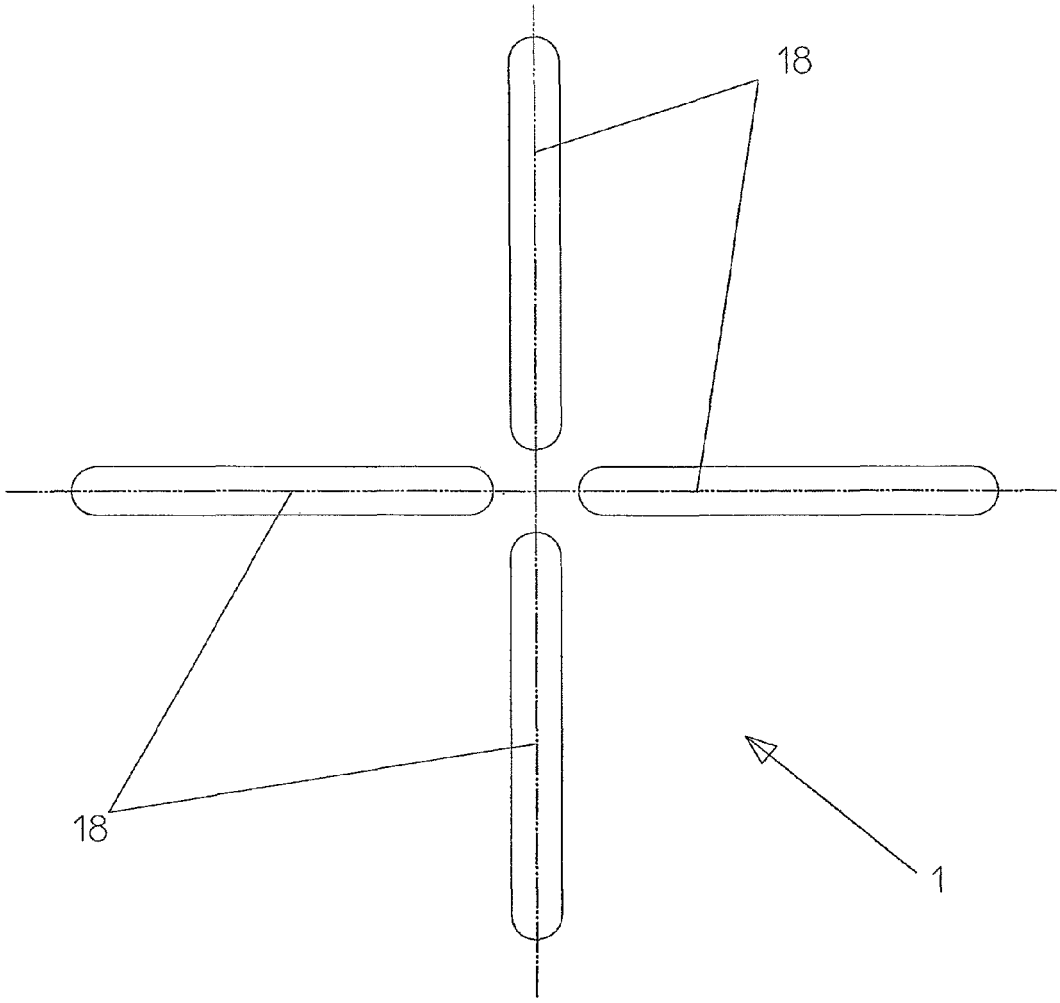
Figure 7:
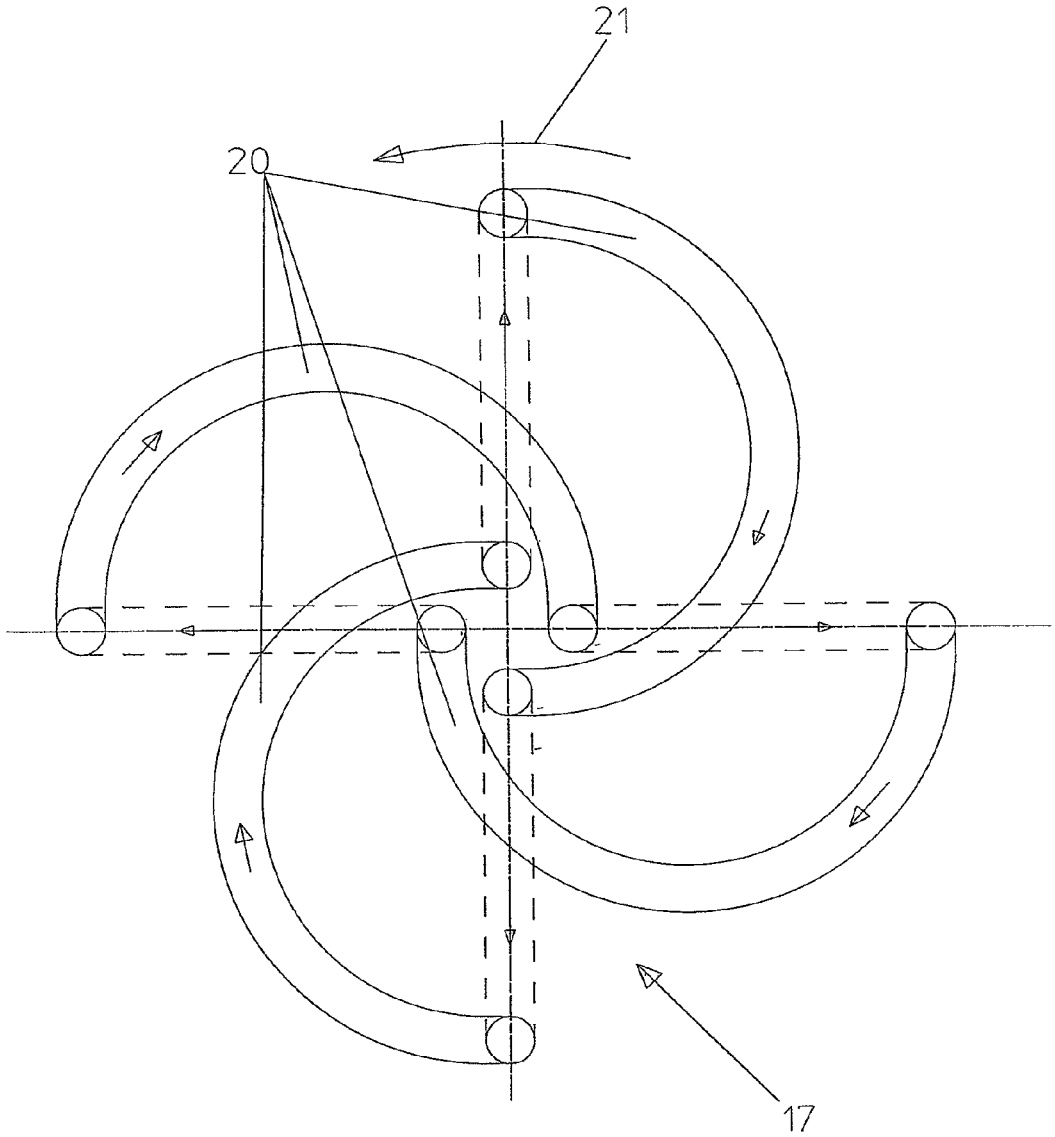
Figure 8:
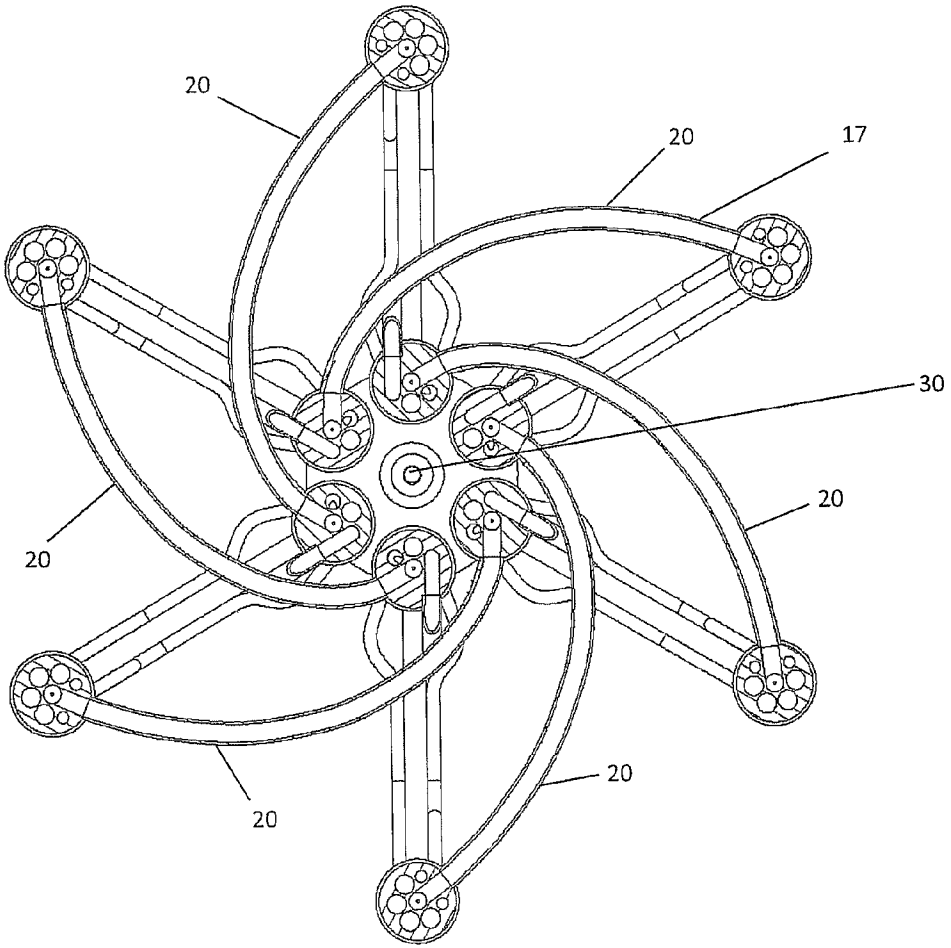
Figure 9:
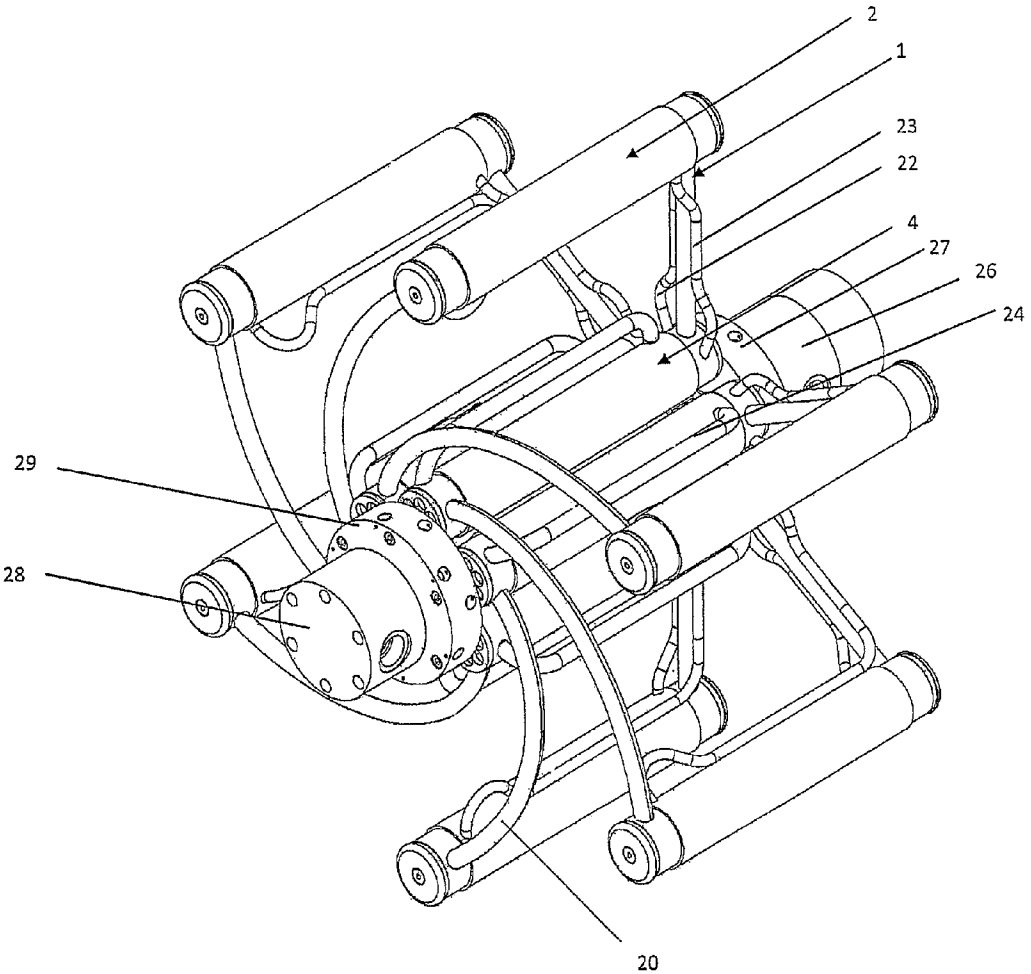
Figure 10:
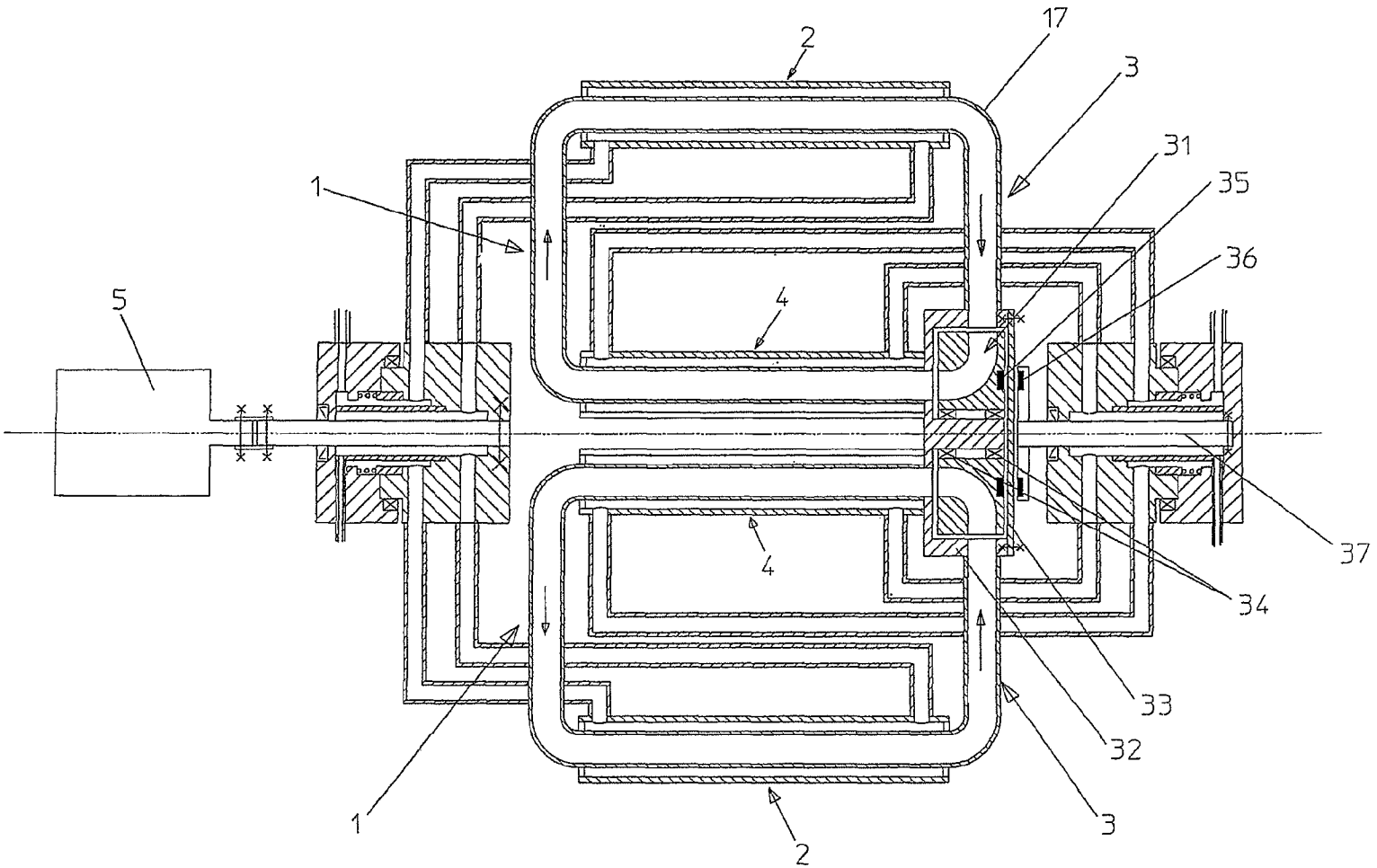
Figure 11:
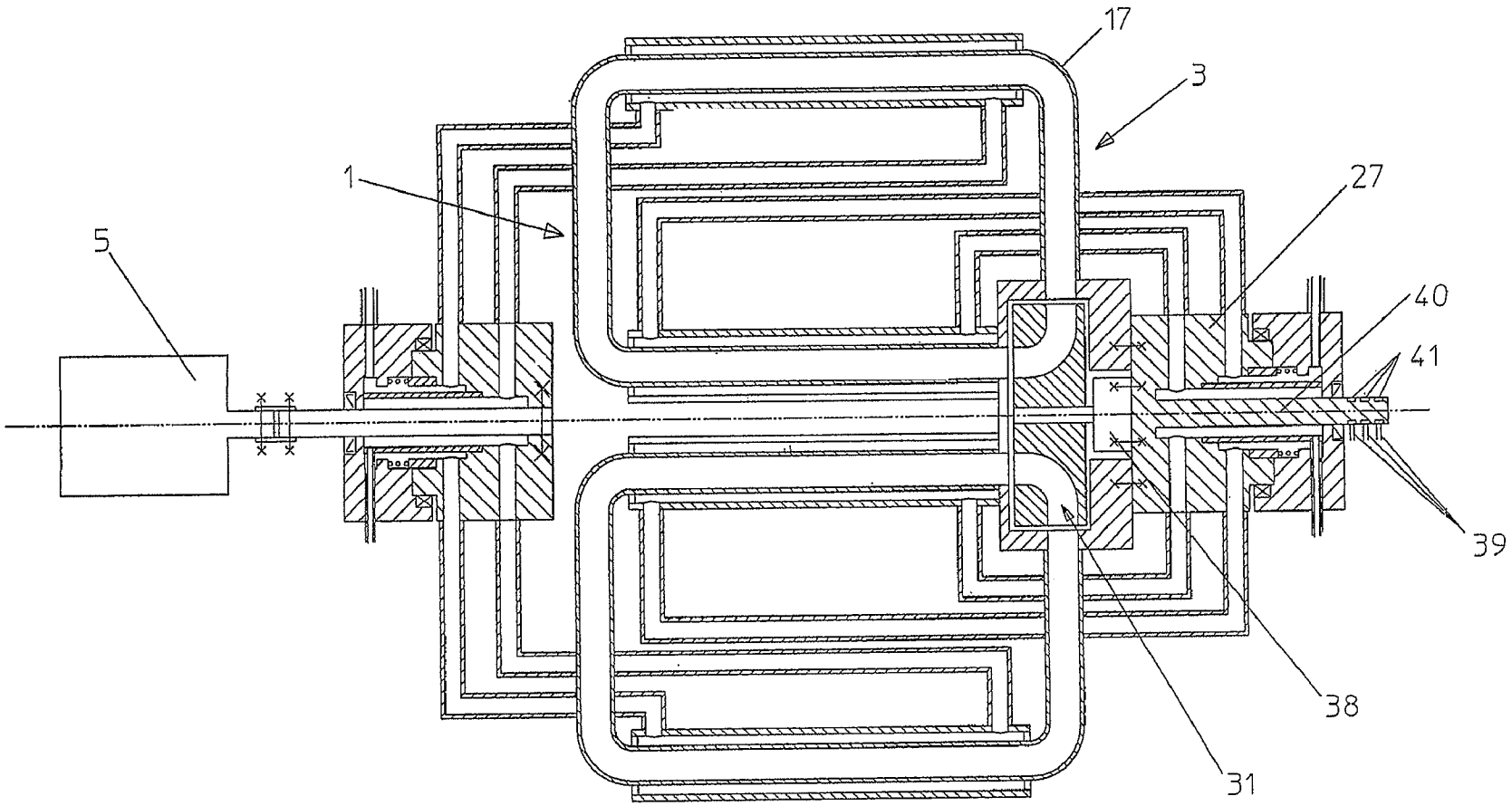

The invention will be described in even greater detail below based on preferred exemplary embodiments depicted in the drawings, but not be limited thereto. Of course, combinations of the described exemplary embodiments are also possible. Specifically shown in the drawings are:

FIG. 1 a diagrammatic process block diagram of the device according to the invention or the method according to the invention during operation as a heat pump;

FIG. 2 a sectional view of a device according to the invention with a co-rotating casing;

FIG. 3 a sectional view of a device according to the invention with a fixed casing;

FIG. 4 a sectional view similar to FIG. 3, but with a motor incorporated inside;

FIG. 5 a sectional view of another exemplary embodiment with pipelines that carry the working medium;

FIG. 6 a section according to the VI-VI line in FIG. 5;

FIG. 7 a section according to the VII-VII line in FIG. 5;

FIG. 8 a sectional view of another exemplary embodiment with a pipeline system that accommodates the working medium;

FIG. 9 a perspective view of the device according to FIG. 8;

FIG. 10 a sectional view of a device similar to FIG. 5, but with the turbine motionless; and FIG. 11 a sectional view similar to FIG. 10, but with a turbine rotating relative to the pipeline system.

FIG. 1 provides a schematic view of a process block diagram of a thermodynamic circulation process of the kind basically known from prior art. In the application as a heat pump depicted, a compressor 1 is initially used to isentropically compress the gaseous working medium. Isobaric heat removal takes place subsequently by way of a heat exchanger 2, so that thermal energy with a high temperature is released and circulated (with water, water/antifreeze or some other liquid heat transfer media) to a thermal circulation system.

An isentropic relaxation is then performed in an expansion unit 3 accommodated in a turbine, thereby recovering mechanical energy. Another heat exchanger 4 is then used to effect an isobaric heat supply, thereby supplying thermal energy at a low temperature to the system by way of a circulation system (with water, water/antifreeze, brine or some other liquid heat transfer media). In this case, thermal energy is normally extracted from well water, from so-called depth probes, in which heat is extracted from the heat exchangers situated at a depth of up to 200 m in the earth and supplied to the heat pump, or the thermal energy is extracted from large heat exchangers (pipelines) lying just underground or from the air. The isobaric heat supply is again followed by isentropic compression by means of compressor 1, as described above.

In cases where the device according to the invention or method according to the invention is used to convert thermal energy at a relatively high temperature into thermal energy at a low temperature, the aforementioned circulation process takes place in the reverse sequence. During operation as a heat pump, a motor 5 is provided for powering a torque shaft 5'; during operation as a heat engine, the motor is replaced by a generator 5 or motor generator 5.

FIG. 2 shows a device according to the invention in which the motor 5 uses a torque shaft 5' to power a compressor 1 with a co-rotating casing 6. In addition, the impellers 1' of the compressor 1 are powered by the torque shaft 5' driven by the electric motor 5, so that the noble gas accommodated in the sealed, motionless casing 8, preferably krypton or xenon, is compressed in the co-rotating casing 6 via centrifugal acceleration.

The co-rotating casing 6 incorporates a spiral pipeline 9 of the heat exchanger 2, which holds a heat exchange medium, e.g., water. The comparatively cold water is incorporated via an inlet 10 into the spiral pipeline 9 in flow direction 10', and is arranged on the outside periphery inside the co-rotating casing 6, so as to achieve an isobaric removal of heat from the working medium with the working medium at the highest possible pressure, making it possible to discharge comparatively warm water at the outlet 11.

The working medium then flows without any significant loss in flow to impellers 3' of the relaxation unit 3, from which mechanical energy is recovered. An isobaric supply of heat then takes place in the motionless casing 8 via a spiral pipeline 12 of the other heat exchanger 4, until the working medium is again subjected to adiabatic isentropic compression via the impellers 1' of the compressor 1.

However, it is only important that the energy of the working medium held in the device comprising a sealed system retain its flow energy during compression in the compressor 1 and/or relaxation in the relaxation unit 3, and a pressure increase or decrease of the working medium is attained solely via centrifugal acceleration of the gas molecules of the working medium. As a result, the efficiency or performance coefficient can be significantly improved while converting thermal energy at a low temperature into thermal energy of a relatively high temperature via electrical or mechanical energy and vice versa.

FIG. 3 shows another exemplary embodiment, wherein a motionless interior casing 6' is here provided. This simplifies the structural design. To keep down flow losses of the gaseous working medium or retain as much as possible of the angular momentum for the working medium, the motionless surfaces which the working medium contacts are as smooth as possible, and there are no heat transfer pipes lying transverse to the flow, which would further increase the pressure loss. The spiral pipeline 9 of the heat exchanger 2 is not freestanding, but rather incorporated in the motionless casing 6' with a smooth surface 2'. In order to increase the performance coefficient or efficiency of the overall device, insulation material 13 is incorporated inside the motionless casing 6'.

FIG. 4 shows another exemplary embodiment, which essentially corresponds to that on FIG. 3, the only difference being the arrangement of the motor 5; specifically, the motor 5 in this exemplary embodiment is accommodated inside the fixed casing 6.

Lines 14 that run through statically compression-proof bushings 15 as well as a stationary motor shaft 16 are provided to supply the motor 5 with power. The motor 5 is here connected with the compressor 1 or relaxation unit 3, so that these co-rotate. This advantageously eliminates dynamic gaskets (gas and liquid gaskets), thereby reducing maintenance work.

FIGS. 5 to 7 show another exemplary embodiment of the device according to the invention, wherein all parts exposed to the pressure of the working medium are designed as pipes or a pipeline system 17, thereby reducing the overall weight of the device, and allowing a thinner wall thickness for the pipes 17 by comparison to that of the casings 6, 6' and 8 depicted on FIGS. 2 to 4.

The working medium is here initially compressed in the radially running compression pipes 18 of the pipeline system 17 of the compressor unit 1 owing to centrifugal acceleration. The heat exchanger 2 here exhibits pipes 19 that are arranged coaxially relative to the outlying section of the pipes 17 running in an axial direction, and envelop the respective pipe 17, so that the heat of the compressed working medium is released countercurrently to the liquid heat exchange medium, of the heat exchanger 2.

The working medium is subsequently relaxed in relaxation pipes 20 (of the relaxation unit 3). The relaxation pipes 20 are here bent opposite the rotational direction 21, of the device, wherein a circulation of the working medium reliably arises as the result of the backward pipe bend (compare FIG. 7).

As evident in particular on FIG. 7, the relaxation pipes 20 can be bent in a semicircular manner, making the latter easy to manufacture in terms of structural design. The working medium subsequently flows in an axial direction in the pipeline system 17, wherein the low-pressure heat exchanger 4 here again exhibits a coaxially arranged pipe 19, so that heat from the liquid heat exchanger medium is released to the cold relaxed working medium.

As evident in particular on FIG. 7, this yields 2 closed pipeline systems 17 essentially shaped like the figure eight when viewed from above for the working medium, which are offset by 90° relative to each other. Of course, the pipeline system 17 can also exhibit a larger number of lines 20; only the rotational symmetry of the arrangement must be preserved for purposes of easier balancing.

The pipes 19 of the heat exchangers 2 and 4 arranged coaxially relative to the axially running sections of the pipes 17 are interconnected by lines 22, 23, 24, 25 that carry liquid, wherein this pipeline system 22 to 25 is rigidly secured with the remaining device, so that the lines 22 to 25 co-rotate. The liquid heat transfer medium is supplied to the pipeline system 17 via a feed 26' of a static distributor 26; the heat exchange medium is then relayed via a co-rotating distributor 27 through the line 22 to the heat exchanger 2, in which it is heated and returned through line 23 to the co-rotating distributor 27. The heated heat transfer medium is then relayed to the heater circulation system by way of the static distributor 26 or a discharge 26".

The cold heat exchange medium of the heat exchanger 4 is guided via a feed 28' of a static distributor 28, conveyed with another co-rotating distributor 29 in this co-rotating line 25 to the low-pressure heat exchanger 4, where heat is released to the gaseous working medium. The heat exchange medium is then routed via the co-rotating line 25 to the co-rotating distributor 29 and then the static distributor 28, after which it exits the device by way of a discharge 28".

A motor 5 is again provided to power the compressor 1, heat exchanger 2, 4 and relaxation unit 3.

FIGS. 8 and 9 show an exemplary embodiment similar to the one on FIGS. 5 to 7, but the relaxation pipes 20 are here not semicircular in terms of cross sectional design, but rather exhibit a continuously diminishing radius toward the midpoint of the rotational axis 30. This yields a monotonously dropping, delayed movement of the working medium, making it possible to reduce any arising turbulence. In addition, the exemplary embodiment shown on FIGS. 8 and 9 depicts two independent pipeline systems 17 offset by 60° relative to each other, wherein three compressions, relaxations, etc. take place per pipeline system 17.

FIG. 10 shows another exemplary embodiment, which in large part corresponds to the one on FIGS. 5 to 7, except that the circulation of the working medium is not achieved by means of pipes 20 bent opposite the rotational direction, but rather with a wheel 31, which acts as a compressor or turbine. The wheel 31 is fixed in place, wherein the relative rotational movement to the pipes 17 surrounding the wheel 31 produce a flow of the working medium in the pipes 17.

In this case, the working medium is relaxed in the pipes 17 of the relaxation unit 3 and routed to the wheel 31, wherein the wheel 31 is accommodated in a wheel casing 32, which is closed by means of a cover 33. The wheel 31 is mounted so that it can rotate via bearings 34, but does exhibit permanent magnets 35, which interact with permanent magnets 36 arranged in a torsion-resistant manner outside the wheel casing 32, thereby fixing the wheel 31 in place. The magnets 36 here rest on a static shaft 37.

FIG. 11 shows a device designed very similarly to the exemplary embodiment depicted in FIG. 10, but the relative rotational movement of the wheel 31 to the pipes 17 of the compressor and relaxation unit 1 and 3 is here generated by means of a motor 38. The motor 38 is secured with the co-rotating distributor 27 in a torsion-resistant manner. The power is here supplied via lines 39, which are accommodated in a shaft 40. The shaft 40 exhibits contacts 41 for purposes of power transmission. In this embodiment, the power supplied by the motor 5 is intended only to overcome the air resistance of the rotating system.

As a result, the latter can therefore be omitted by using turbines in the circulation system of the liquid heat transfer medium, which remove this power from the circulation. The power required for overcoming the air resistance is then additionally provided by the pumps, which drive the circulating liquid heat transfer medium.

The invention claimed is:

1. A method for converting thermal energy at a low temperature into thermal energy at a relatively high temperature by means of mechanical energy and vice versa with a working medium, the working medium runs through a closed thermodynamic circulation process, wherein the circulation process exhibits the following working steps:

adiabatic compression of the working medium, isobaric conduction of heat away from the working medium by means of a heat exchange medium, Reversible adiabatic relaxing of the working medium, Isobaric supply of heat to the working medium by means of a heat exchange medium, wherein, in order to increase or decrease the pressure of the working medium during compression or relaxation, the working medium is relayed essentially radially outward or inward in relation to a rotational axis, and generates an increase or decrease in the centrifugal force acting on the working medium, where in the working medium during the closed circulation process as well as the heat exchange media are routed around the rotational axis for purposes of heat supply and removal, so that the flow energy of the working medium is essentially retained during the closed circulation process.

2. The method according to claim 1, where in the working medium is gaseous during the entire circulation process.

3. The method according to claim 1, where in a noble gas is used as the working medium, in particular krypton, xenon, argon, radon or a mixture thereof.

4. The method according to claim 1, where in the pressure in the closed circulation process measures at least in excess of 50 bar, in particular in excess of 70 bar, preferably essentially 100 bar.

5. The method according to claim 2, where in the circulation process is carried out in close proximity to the critical point of the gaseous working medium.

6. The method according to claim 1, where in heat is removed and supplied using a heat exchange medium with an isentropic exponent Kappa .about.1, in particular a liquid heat exchange medium.

7. A device for implementing a method according to claim 1, with a compressor, a relaxation unit and a respective heat exchanger for supplying or removing heat, wherein the compressor and relaxation unit are mounted so that they can rotate around a rotational axis, and the compressor or relaxation unit are designed in such a way that the working medium in the compressor is essentially carried radially outward in relation to the rotational axis, or essentially carried radially inward in the expansion unit, thereby increasing or decreasing the pressure by increasing or decreasing the centrifugal force acting on the working medium, characterized in that the heat exchangers are designed to rotate together with the compressor and relaxation unit, and the working medium is relayed around the rotational axis during the closed circulation process, so that the flow energy of the working medium is essentially retained during the closed circulation process.

8. The device according to claim 7, characterized in that the heat exchangers each exhibit at least one pipe that carries a liquid heat transfer medium.

9. The device according to claim 7, where in the relaxation unit connects directly to the compressor via the heat exchangers.

10. The device according to claim 7, where in impellers of the compressor and the relaxation unit are mounted on a shared torque shaft.

11. The device according to claim 10, where in a casing is provided that co-rotates with the impellers of the compressor and the relaxation unit.

12. The device according to claim 9, where in the impellers are enveloped by a motionless casing.

13. The device according to claim 11, where in the pipe of the heat exchanger is partially incorporated into the casing.

14. The device according to claim 7, where in a torsion-resistant casing that envelops the compressor and the relaxation unit is provided.

15. The device according to claim 14, where in the two heat exchanges are incorporated into the casing.

16. The device according to claim 7, where in at least one rotatably mounted pipeline system is provided, the pipe line system circulates the working medium.

17. The device according to claim 16, where in the pipeline system exhibits linear compression pipes that run in a radial direction.

18. The device according to claim 16, where in that the pipeline system exhibits relaxation pipes bent against the rotational direction of the torque shaft.

19. The device according to claim 18, where in the relaxation pipes are circularly bent in cross section.

20. The device according to claim 18, where in the relaxation pipes exhibit a bend with a cross sectional radius, the cross sectional radius constantly diminishes towards the rotation center.

21. The device according to claim 16, where in the pipeline system incorporates a turbine, the turbine rotates relative to the pipeline system.

22. The device according to claim 21, where in the turbine is arranged in a torsion-resistant manner.

23. The device according to claim 21, where in the turbine is provided with an electric motor for generating a relative movement to the pipeline system.

24. The device according to claim 16, where in axially running sections of the pipeline system are enveloped by coaxially arranged pipes of the heat exchangers.

25. The device according to claim 10, where in an electric motor or generator is connected with the torque shaft or the pipeline system.

* * * * *